US011274406B2

(12) United States Patent
Brown

(10) Patent No.: US 11,274,406 B2
(45) Date of Patent: Mar. 15, 2022

(54) CULVERT TO DITCH TRANSITIONING DEVICE

(71) Applicant: Johnny Brown, Midlothian, VA (US)

(72) Inventor: Johnny Brown, Midlothian, VA (US)

( * ) Notice: Subject to any disclaimer, the term of this patent is extended or adjusted under 35 U.S.C. 154(b) by 88 days.

(21) Appl. No.: 16/834,831

(22) Filed: Mar. 30, 2020

(65) Prior Publication Data

US 2021/0301484 A1 Sep. 30, 2021

(51) Int. Cl.
*E01F 5/00* (2006.01)
*E03F 3/00* (2006.01)

(52) U.S. Cl.
CPC ..... *E01F 5/005* (2013.01)

(58) Field of Classification Search
CPC ..... E01F 5/005; E03F 3/00
USPC ..... 405/125
See application file for complete search history.

(56) References Cited

U.S. PATENT DOCUMENTS

| | | | | |
|---|---|---|---|---|
| 354,897 | A * | 12/1886 | Goodridge, Jr. | E01F 5/005 405/125 |
| 1,144,200 | A * | 6/1915 | Hewett | E01F 5/005 405/125 |
| 4,723,871 | A | 2/1988 | Roscoe | |
| 4,865,900 | A | 9/1989 | Shannon | |
| 5,679,189 | A | 10/1997 | Jarboe | |
| D713,734 | S | 9/2014 | Pereira | |
| D754,811 | S | 4/2016 | Thomason | |
| D795,992 | S | 8/2017 | May | |
| 2002/0127061 | A1* | 9/2002 | Hartman | E01F 5/005 405/125 |

* cited by examiner

*Primary Examiner* — Tara Mayo-Pinnock

(57) ABSTRACT

A culvert to ditch transitioning device for lining a ditch proximate to an end of a culvert includes an end panel, which has an orifice positioned therein, and a pair of side panels. A terminal segment of the culvert, which extends into the ditch, can be inserted through the orifice so that a first face of the end panel is in substantial abutment with an end embankment of the ditch. Each side panel is coupled to a respective opposed end of the end panel and extends substantially perpendicularly therefrom. The pair of the side panels lines side embankments of the ditch, proximate to the end embankment. The end embankment and the lined portions of the side embankments thus no longer require lawn care, such as mowing, trimming, and weeding.

19 Claims, 6 Drawing Sheets

CULVERT TO DITCH TRANSITIONING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to culvert transitioning devices and more particularly pertains to a new culvert transitioning device for lining a ditch proximate to an end of a culvert.

(2) Description of Related Art Including Information Disclosed Under 37 CFR 1.97 and 1.98

The prior art relates to culvert transitioning devices. Prior art devices that cover a surface proximate to an end of culvert may comprise a panel having an aperture positioned therethrough.

BRIEF SUMMARY OF THE INVENTION

An embodiment of the disclosure meets the needs presented above by generally comprising an end panel, which has an orifice positioned therein, and a pair of side panels. The orifice is configured for insertion of a terminal segment of a culvert that extends into a ditch. A first face of the end panel is in substantial abutment with an end embankment of the ditch. Each side panel is coupled to a respective opposed end of the end panel and extends substantially perpendicularly therefrom. The pair of the side panels is configured to line side embankments of the ditch, proximate to the end embankment. The end embankment and the lined portions of the side embankments thus no longer require lawn care, such as mowing, trimming, and weeding.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
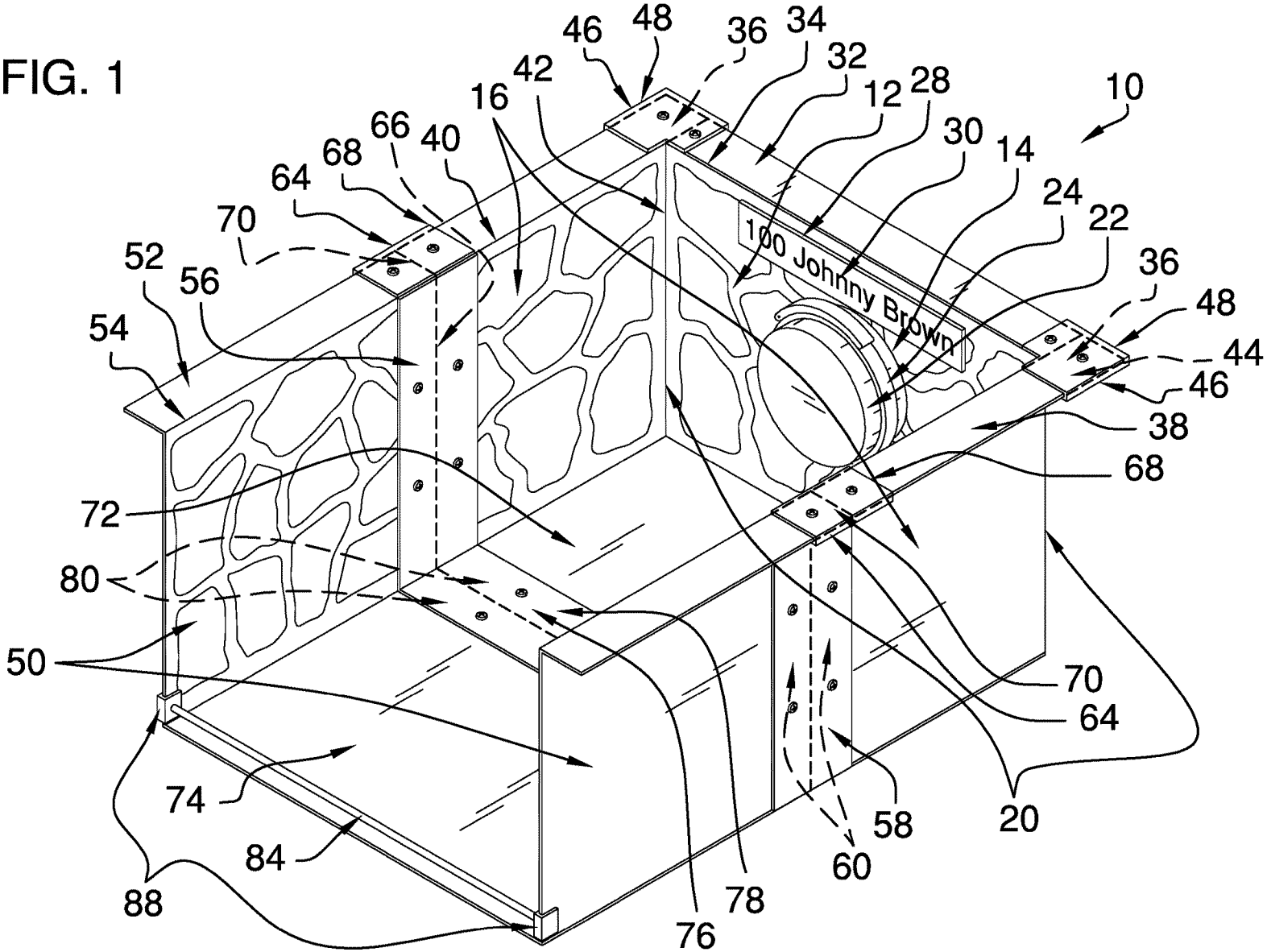
FIG. 1 is an isometric perspective view of a culvert to ditch transitioning device according to an embodiment of the disclosure.
Figure 2:
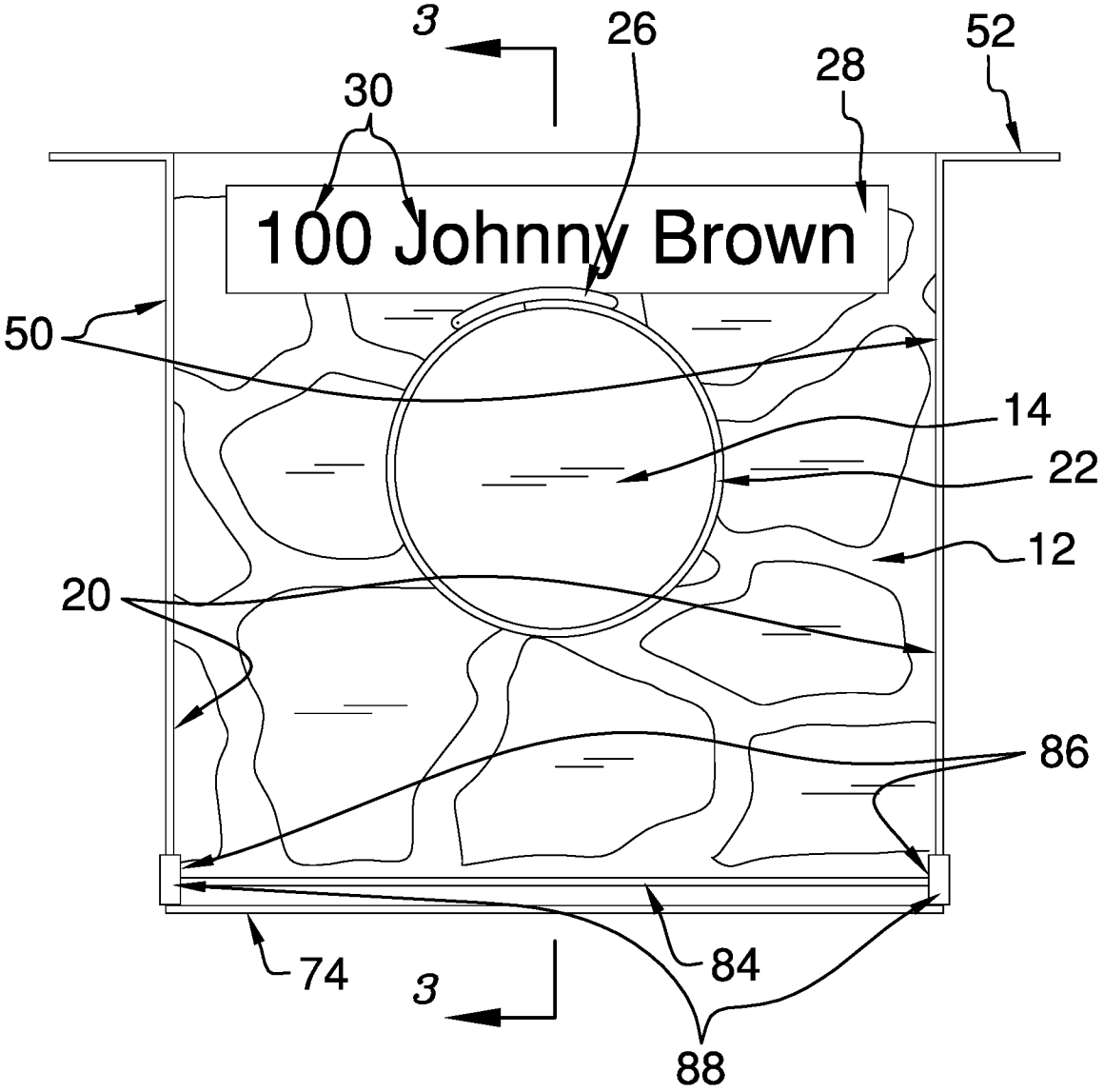
FIG. 2 is a front view of an embodiment of the disclosure.
Figure 3:
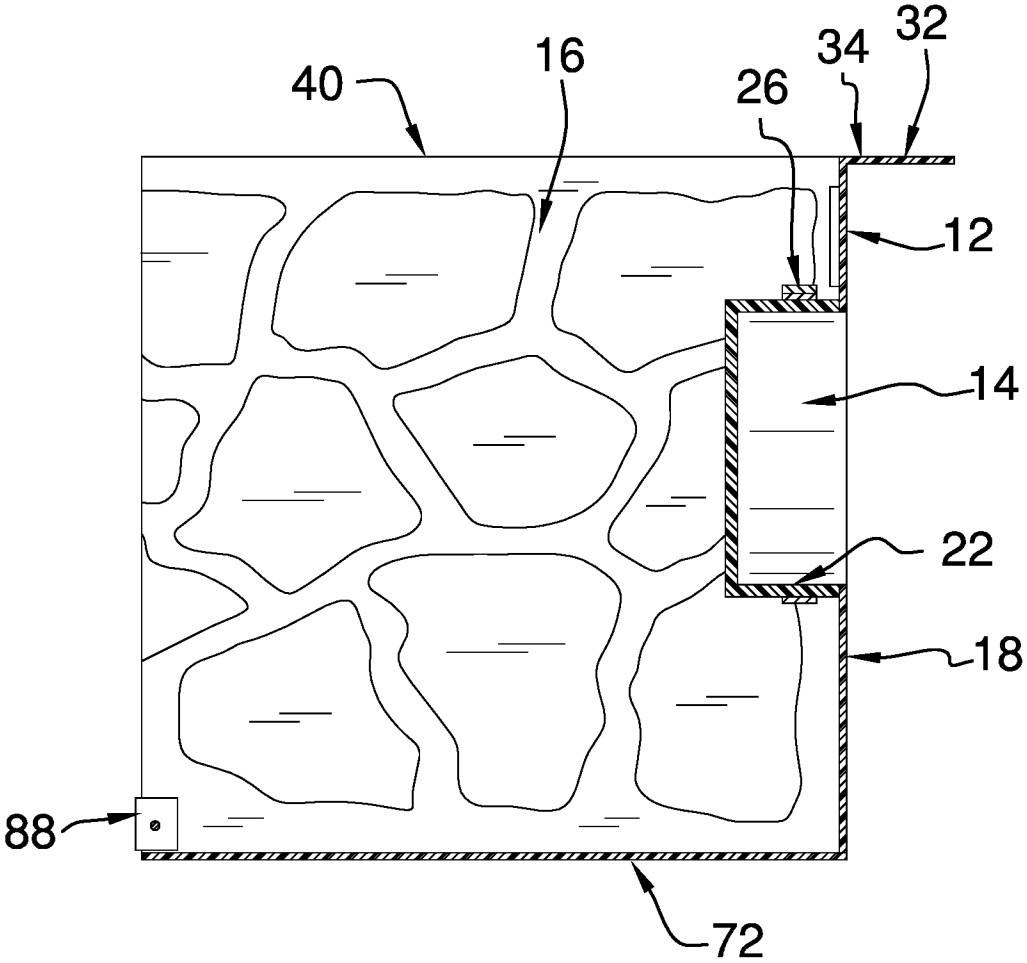
FIG. 3 is a cross-sectional view of an embodiment of the disclosure.

With reference now to the drawings, and in particular to FIGS. 1 through 6 thereof, a new culvert transitioning device embodying the principles and concepts of an embodiment of the disclosure and generally designated by the reference numeral 10 will be described.

As best illustrated in FIGS. 1 through 6, the culvert to ditch transitioning device 10 generally comprises an end panel 12, which has an orifice 14 positioned therein, and a pair of side panels 16. The orifice 14 is configured for insertion of a terminal segment of a culvert that extends into a ditch. A first face 18 of the end panel 12 thus is positioned in substantial abutment with an end embankment of the ditch.

Figure 5:
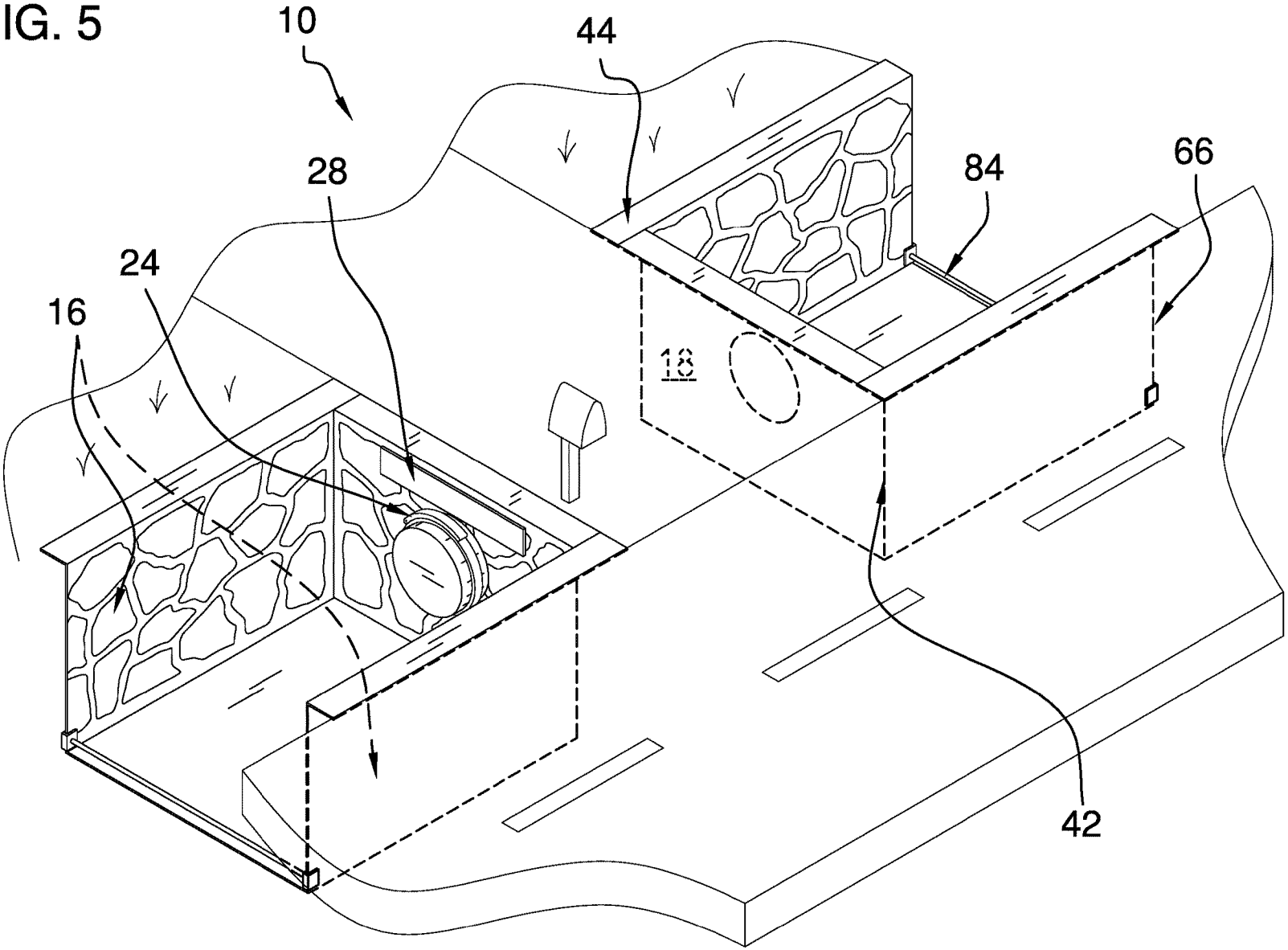
FIG. 5 is an in-use view of an embodiment of the disclosure.
Figure 6:
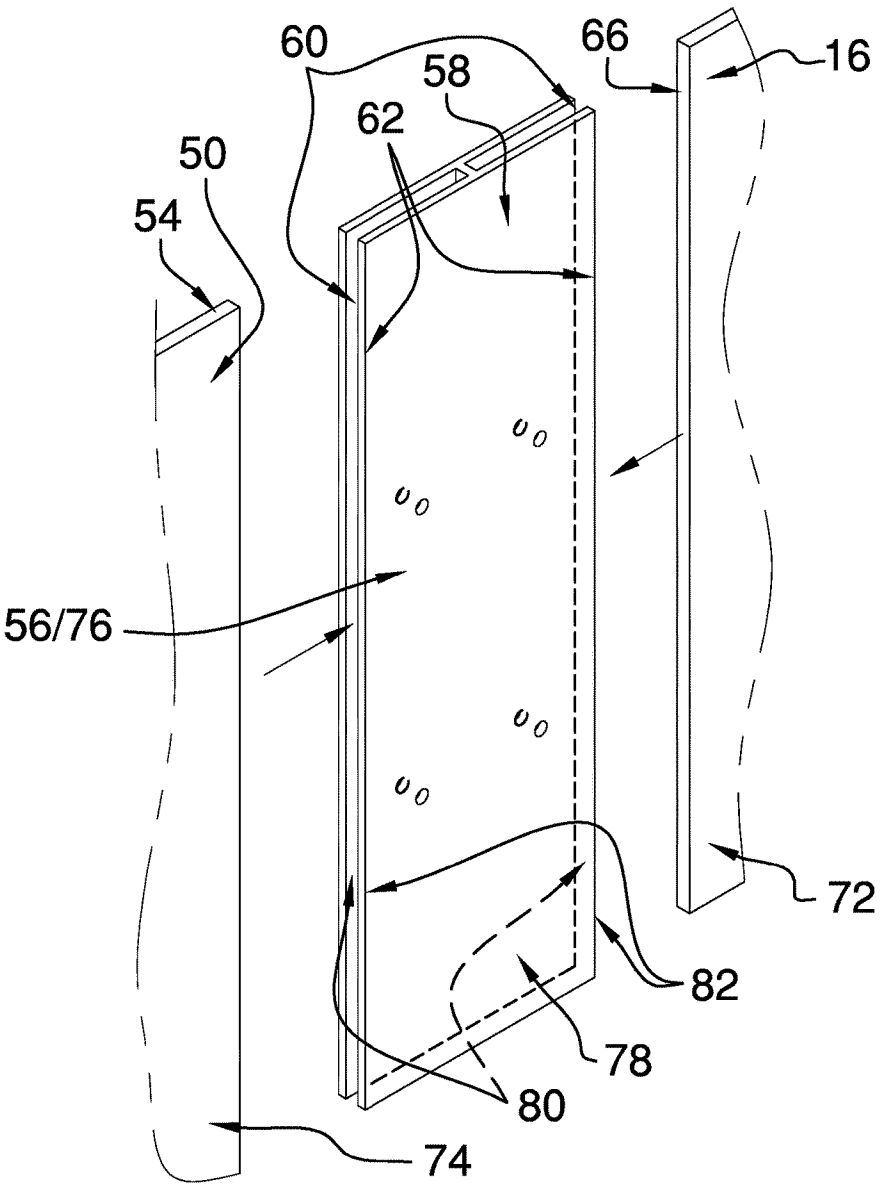
FIG. 6 is a detail view of an embodiment of the disclosure.

Each side panel 16 is coupled to a respective opposed end 20 of the end panel 12 and extends substantially perpendicularly therefrom. The pair of the side panels 16 is configured to line side embankments of the ditch, proximate to the end embankment. The end embankment and the lined portions of the side embankments thus no longer require lawn care, such as mowing, trimming, and weeding. The pair of side panels 16 and the end panel 12 may be textured and thus configured to mimic walls that comprises a plurality of stones, as shown in FIG. 5.

A tube 22 is coupled to the end panel 12 and extends from the orifice 14. The tube 22 extends codirectionally with the side panels 16 from the end panel 12. The tube 22 is configured for insertion of the terminal segment of the culvert. A fastener 24 is engaged to the tube 22 and is configured to engage the culvert to fixedly couple the tube 22 to the terminal segment of the culvert. The fastener 24 may comprise a ring clamp 26, or other fastening means, such as, but not limited to, screws, adhesives, and the like.

The device 10 may comprise a plaque 28, which is selectively engageable to the end panel 12. The plaque 28 has indicia 30 coupled thereto, which are configured to indicate a location, such as an address, of the culvert. The present invention anticipates at least one of the plaque 28 and the indicia 30 being reflective of light that impinges thereupon, which would render the indicia 30 more viewable in low light conditions.

The end panel 12 has an end lip 32 coupled thereto and extending from an upper limit 34 thereof past the first face 18. The end lip 32 is configured to abut a top of the end embankment, as shown in FIG. 5. The end lip 32 extends past the opposed ends 20 of the end panel 12 to define a pair of end tabs 36.

Each side panel 16 has a side lip 38 coupled thereto and extending from an upper end 40 thereof. The side lips 38 extend opposingly from the pair of side panels 16. Each side lip 38 is configured to abut a top face of a respective side embankment, as shown in FIG. 5. The side lip 38 extends past a first end 42 of the side panel 16 to define a side tab 44. The side tab 44 is positioned to overlay an associated end tab 36 and is configured to be screwed to the end tab 36 to couple the side lip 38 to the end lip 32. For example, the side tab 44 and associated end tab 36 can be drilled and screwed, or a self-tapping screw could be used without prior drilling. The present invention also anticipates the side lip 38 and end lip 32 being predrilled, as well as other coupling means for coupling the side lip 38 to the end lip 32, such as, but not limited to, adhesives, clamps, and the like.

The device 10 may comprise a corner connector 46, which is configured to engage a side tab 44 of a respective side lip 38, proximate to the first end 42 of an associated side panel 16. The corner connector 46 is configured to engage the end lip 32 of the end panel 12 to couple the respective side lip 38 to the end lip 32. The corner connector 46 would be employed in event the end panel 12 is cut to size to fit the end embankment of the ditch, as doing so would remove the end tab 36.

The corner connector 46 may comprise a corner sleeve 48, which is L-shaped. The corner sleeve 48 is configured to be screwed to the respective side lip 38 and the end lip 32 to couple the respective side lip 38 to the end lip 32. For example, the corner sleeve 48, the side tab 44, and the end tab 36 can be drilled and screwed, or a self-tapping screw could be used without prior drilling. The present invention also anticipates the corner sleeve 48 and the side tab 44 being predrilled, as well as other coupling means for coupling the corner sleeve 48 to the side tab 44 and to the end tab 36, such as, but not limited to, adhesives, clamps, and the like.

The device 10 may comprise a pair of side extenders 50. Each side extender 50 is selectively engageable to an associated side panel 16, so that the side extender 50 extends substantially coplanarly from the associated side panel 16. The side extender 50 is configured to extend the lining of a respective side embankment. The side extender 50 has an extender lip 52 coupled thereto and extending from a top limit 54 thereof. The extender lips 52 extend opposingly from the pair of side extenders 50. Each extender lip 52 is configured to abut the top face of a respective side embankment.

A side connector 56 is configured to engage a respective side panel 16, proximate to a second end 66 of the respective side panel 16, and to engage an associated side extender 50, to couple the respective side panel 16 to the associated side extender 50. The side connector 56 may comprise a side plate 58, which has a pair of side channels 60 extending thereinto from side edges 62 thereof. One of the side channels 60 is positioned for insertion of the respective side panel 16 and the other of the side channels 60 is positioned for insertion of the associated side extender 50. The side plate 58 is configured to be screwed to the respective side panel 16 and the associated side extender 50 to couple the respective side panel 16 to the associated side extends panel. For example, the side plate 58, the respective side panel 16, and the associated side extender 50 can be drilled and screwed, or a self-tapping screw could be used without prior drilling. The present invention also anticipates the side plate 58, the respective side panel 16, and the associated side extender 50 being predrilled, as well as other coupling means for coupling the corner sleeve 48 to the side plate 58 to the respective side panel 16 and the associated side extender 50, such as, but not limited to, adhesives, clamps, and the like.

The device 10 may comprise a lip connector 64, which is configured to engage a side lip 38 of a respective side panel 16, proximate to the second end 66 of the respective side panel 16. The lip connector 64 also is configured to engage the extender lip 52 of an associated side extender 50 to couple the side lip 38 to the extender lip 52. The lip connector 64 may comprise a lip sleeve 68, which is configured for insertion of the side lip 38 and the extender lip 52, proximate to an abutment point 70 thereof. The lip sleeve 68 is configured to be screwed to the side lip 38 and the extender lip 52 to couple the side lip 38 to the extender lip 52. For example, the lip connector 64, the side lip 38, and the extender lip 52 can be drilled and screwed, or a self-tapping screw could be used without prior drilling. The present invention also anticipates the lip connector 64, the side lip 38, and the extender lip 52 being predrilled, as well as other coupling means for coupling the lip connector 64 to the side lip 38 and to the extender lip 52, such as, but not limited to, adhesives, clamps, and the like.

The device 10 may comprise a bottom panel 72, which is coupled to and which extends between the pair of side panels 16. The bottom panel 72 is configured to cover a bottom of the ditch. A bottom extender 74 is selectively positionable between the pair of side extenders 50 and selectively engageable to the bottom panel 72 to extend the covering of the bottom of the ditch.

The device 10 may comprise a bottom connector 76, which is configured to engage the bottom panel 72 and the bottom extender 74 to couple the bottom extender 74 to the bottom panel 72. The bottom connector 76 may comprise a bottom plate 78, which has a pair of bottom channels 80 extending thereinto from side limits 82 thereof. One of the bottom channels 80 is positioned for insertion of the bottom panel 72 and the other of the bottom channels 80 is positioned for insertion of the bottom extender 74. The bottom plate 78 is configured to be screwed to the bottom panel 72 and the bottom extender 74 to couple the bottom panel 72 to the bottom extender 74. For example, the bottom plate 78, the bottom panel 72, and the bottom extender 74 can be drilled and screwed, or a self-tapping screw could be used without prior drilling. The present invention also anticipates the bottom plate 78, the bottom panel 72, and the bottom extender 74 being predrilled, as well as other coupling means for coupling the bottom plate 78 to the bottom panel 72 and to the bottom extender 74, such as, but not limited to, adhesives, clamps, and the like.

Figure 4:
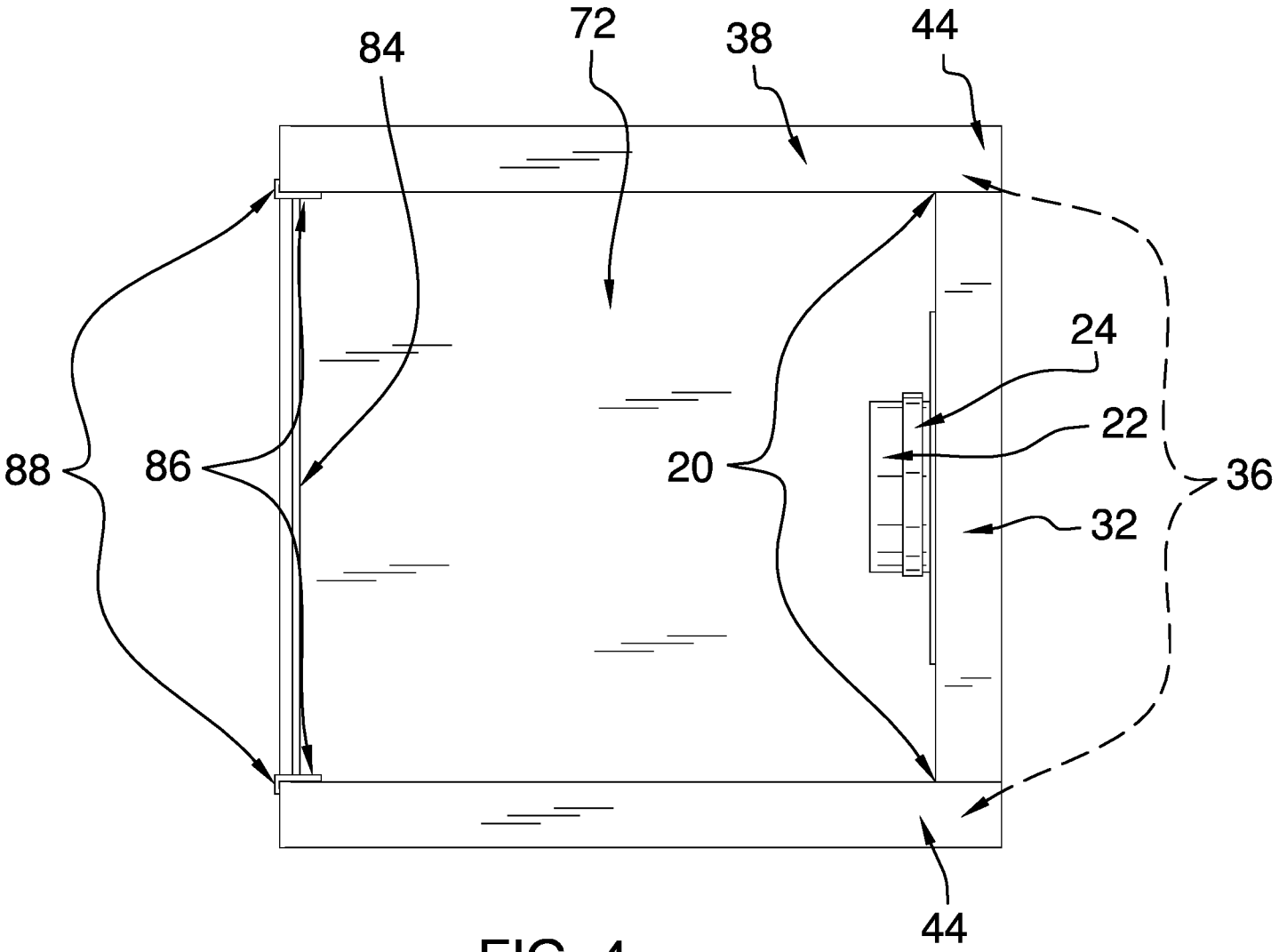
FIG. 4 is a top view of an embodiment of the disclosure.

The device 10 may comprise a rod 84, which has opposing ends 86. Each opposing end 86 is configured to selectively couple to a respective side extender 50 so that the rod 84 extends between the pair of side extenders 50, as shown in FIG. 1. The rod 84 thus is configured to fixedly separate the side extenders 50. The present invention also anticipates the rod 84 being selectively coupled to the pair of side panels 16 to fixedly separate the side panels 16, as shown in FIG. 4. A pair of clamps 88 is engaged singly to the opposing ends 86 of the rod 84 and is positioned to be clamped to the pair of side extenders 50 to fixedly position the rod 84 between the side extenders 50.

In use, the terminal segment of the culvert is inserted into the tube 22 so the first face 18 of the end panel 12 is positioned in abutment to the end embankment. The ring clamp 26 then is tightened to secure the tube 22 to the culvert. The side panels 16 extend from the end panel 12 and line the side embankments of the ditch. If desired, the side extenders 50 can be added to the side panels 16 to extend the lining of the side embankments further from the end embankment.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A culvert to ditch transitioning device comprising:

an end panel having an orifice positioned therein, wherein the orifice is configured for inserting a terminal segment of a culvert extending into a ditch, such that a first face of the end panel is in substantial abutment with an end embankment of the ditch;

a pair of side panels, each side panel being coupled to a respective opposed end of the end panel and extending substantially perpendicularly therefrom, wherein the pair of the side panels is configured for lining side embankments of the ditch proximate to the end embankment;

a tube coupled to the end panel and extending from the orifice, the tube extending codirectionally with the side panels from the end panel, wherein the tube is configured for inserting the terminal segment of the culvert; and a fastener engaged to the tube and being configured for engaging the culvert, wherein the fastener is configured for fixedly coupling the tube to the terminal segment of the culvert.

2. The culvert to ditch transitioning device of claim 1, wherein the pair of side panels and the end panel are textured, wherein the side panels and the end panel are configured for mimicking walls comprising a plurality of stones.

3. The culvert to ditch transitioning device of claim 1, wherein:

the end panel has an end lip coupled thereto and extending from an upper limit thereof past the first face, wherein the end lip is configured for abutting a top of the end embankment; and each side panel has a side lip coupled thereto and extending from an upper end thereof, such that the side lips extend opposingly from the pair of side panels, wherein each side lip is configured for abutting a top face of a respective side embankment.

4. The culvert to ditch transitioning device of claim 1, further including a bottom panel coupled to and extending between the pair of side panels wherein the bottom panel is configured for covering a bottom of the ditch.

5. The culvert to ditch transitioning device of claim 1, the fastener comprises a ring clamp.

6. The culvert to ditch transitioning device of claim 1, further including a plaque selectively engageable to the end panel, the plaque having indicia coupled thereto, wherein the indicia are configured for indicating a location of the culvert.

7. The culvert to ditch transitioning device of claim 6, wherein at least one of the plaque and the indicia being reflective of light impinging thereupon.

8. A culvert to ditch transitioning device comprising:

an end panel having an orifice positioned therein, wherein the orifice is configured for inserting a terminal segment of a culvert extending into a ditch, such that a first face of the end panel is in substantial abutment with an end embankment of the ditch;

a pair of side panels, each side panel being coupled to a respective opposed end of the end panel and extending substantially perpendicularly therefrom, wherein the pair of the side panels is configured for lining side embankments of the ditch proximate to the end embankment;

wherein the end panel has an end lip coupled thereto and extending from an upper limit thereof past the first face, wherein the end lip is configured for abutting a top of the end embankment;

wherein each side panel has a side lip coupled thereto and extending from an upper end thereof, such that the side lips extend opposingly from the pair of side panels, wherein each side lip is configured for abutting a top face of a respective side embankment;

the end lip extending past opposed ends of the end panel defining a pair of end tabs; and the side lip extending past a first end of the side panel defining a side tab, such that the side tab is positioned for overlaying an associated end tab, the side tab being configured for screwing to the end tab for coupling the side lip to the end lip.

9. The culvert to ditch transitioning device of claim 8, further including a corner connector configured for engaging a side tab of a respective side lip, proximate to the first end of an associated side panel, the corner connector being configured for engaging the end lip of the end panel for coupling the respective side lip to the end lip.

10. The culvert to ditch transitioning device of claim 9, wherein the corner connector comprises a corner sleeve, the corner sleeve L-shaped, the corner sleeve being configured for screwing to the respective side lip and the end lip for coupling the respective side lip to the end lip.

11. A culvert to ditch transitioning device comprising:

an end panel having an orifice positioned therein, wherein the orifice is configured for inserting a terminal segment of a culvert extending into a ditch, such that a first face of the end panel is in substantial abutment with an end embankment of the ditch;

a pair of side panels, each side panel being coupled to a respective opposed end of the end panel and extending substantially perpendicularly therefrom, wherein the pair of the side panels is configured for lining side embankments of the ditch proximate to the end embankment;

wherein the end panel has an end lip coupled thereto and extending from an upper limit thereof past the first face, wherein the end lip is configured for abutting a top of the end embankment;

wherein each side panel has a side lip coupled thereto and extending from an upper end thereof, such that the side lips extend opposingly from the pair of side panels, wherein each side lip is configured for abutting a top face of a respective side embankment;

a pair of side extenders, each side extender being selectively engageable to an associated side panel, such that the side extender extends substantially coplanarly from the associated side panel, wherein the side extender is configured for extending the lining of a respective side embankment, the side extender having an extender lip coupled thereto and extending from a top limit thereof, such that the extender lips extend opposingly from the pair of side extenders, wherein each extender lip is configured for abutting the top face of a respective side embankment; and a lip connector configured for engaging a side lip of a respective side panel, proximate to a second end of the respective side panel, the lip connector being configured for engaging the extender lip of an associated side extender for coupling the side lip to the extender lip.

12. The culvert to ditch transitioning device of claim 11, wherein the lip connector comprises a lip sleeve configured for inserting the side lip and the extender lip, proximate to an abutment point thereof, the lip sleeve being configured for screwing to the side lip and the extender lip for coupling the side lip to the extender lip.

13. The culvert to ditch transitioning device of claim 11, further including a side connector configured for engaging a respective side panel, proximate to the second end of the respective side panel, and for engaging an associated side extender for coupling the respective side panel to the associated side extender.

14. The culvert to ditch transitioning device of claim 13, wherein the side connector comprises a side plate, the side plate having a pair of side channels extending thereinto from side edges thereof, such that one of the side channels is positioned for inserting the respective side panel and the other of the side channels is positioned for inserting the associated side extender, the side plate being configured for screwing to the respective side panel and the associated side extender for coupling the respective side panel to the associated side extending panel.

15. The culvert to ditch transitioning device of claim 11, further including a rod having opposing ends, each opposing end being configured for selectively coupling to a respective side extender such that the rod extends between the pair of side extenders, wherein the rod is configured for fixedly separating the side extenders.

16. The culvert to ditch transitioning device of claim 15, further including a pair of clamps engaged singly to the opposing ends of the rod, such that the clamps are positioned for clamping to the pair of side extenders for fixedly positioning the rod between the side extenders.

17. A culvert to ditch transitioning device comprising:

an end panel having an orifice positioned therein, wherein the orifice is configured for inserting a terminal segment of a culvert extending into a ditch, such that a first face of the end panel is in substantial abutment with an end embankment of the ditch;

a pair of side panels, each side panel being coupled to a respective opposed end of the end panel and extending substantially perpendicularly therefrom, wherein the pair of the side panels is configured for lining side embankments of the ditch proximate to the end embankment;

a bottom panel coupled to and extending between the pair of side panels wherein the bottom panel is configured for covering a bottom of the ditch;

a bottom extender selectively positionable between the pair of side extenders and selectively engageable to the bottom panel for extending the covering of the bottom of the ditch; and a bottom connector configured for engaging the bottom panel and the bottom extender for coupling the bottom extender to the bottom panel.

18. The culvert to ditch transitioning device of claim 17, wherein the bottom connector comprises a bottom plate, the bottom plate having a pair of bottom channels extending thereinto from side limits thereof, such that one of the bottom channels is positioned for inserting the bottom panel and the other of the bottom channels is positioned for inserting the bottom extender, the bottom plate being configured for screwing to the bottom panel and the bottom extender for coupling the bottom panel to the bottom extender.

19. A culvert to ditch transitioning device comprising:

an end panel having an orifice positioned therein, wherein the orifice is configured for inserting a terminal segment of a culvert extending into a ditch, such that a first face of the end panel is in substantial abutment with an end embankment of the ditch, the end panel having an end lip coupled thereto and extending from an upper limit thereof past the first face, wherein the end lip is configured for abutting a top of the end embankment, the end lip extending past opposed ends of the end panel defining a pair of end tabs;

a pair of side panels, each side panel being coupled to a respective opposed end of the end panel and extending substantially perpendicularly therefrom, wherein the pair of the side panels is configured for lining side embankments of the ditch proximate to the end embankment, the pair of side panels and the end panel being textured, wherein the side panels and the end panel are configured for mimicking walls comprising a plurality of stones, each side panel having a side lip coupled thereto and extending from an upper end thereof, such that the side lips extend opposingly from the pair of side panels, wherein each side lip is configured for abutting a top face of a respective side embankment, the side lip extending past a first end of the side panel defining a side tab, such that the side tab is positioned for overlaying an associated end tab, the side tab being configured for screwing to the end tab for coupling the side lip to the end lip;

a corner connector configured for engaging a side tab of a respective side lip, proximate to the first end of an associated side panel, the corner connector being configured for engaging the end lip of the end panel for coupling the respective side lip to the end lip, the corner connector comprising a corner sleeve, the corner sleeve L-shaped, the corner sleeve being configured for screwing to the respective side lip and the end lip for coupling the respective side lip to the end lip;

a bottom panel coupled to and extending between the pair of side panels wherein the bottom panel is configured for covering a bottom of the ditch;

a tube coupled to the end panel and extending from the orifice, the tube extending codirectionally with the side panels from the end panel, wherein the tube is configured for inserting the terminal segment of the culvert;

a fastener engaged to the tube and being configured for engaging the culvert, wherein the fastener is configured for fixedly coupling the tube to the terminal segment of the culvert, the fastener comprising a ring clamp;

a plaque selectively engageable to the end panel, the plaque having indicia coupled thereto, wherein the indicia are configured for indicating a location of the culvert, at least one of the plaque and the indicia being reflective of light impinging thereupon;

a pair of side extenders, each side extender being selectively engageable to an associated side panel, such that the side extender extends substantially coplanarly from the associated side panel, wherein the side extender is configured for extending the lining of a respective side embankment, the side extender having an extender lip coupled thereto and extending from a top limit thereof, such that the extender lips extend opposingly from the pair of side extenders, wherein each extender lip is configured for abutting the top face of a respective side embankment;

a lip connector configured for engaging a side lip of a respective side panel, proximate to a second end of the respective side panel, the lip connector being configured for engaging the extender lip of an associated side extender for coupling the side lip to the extender lip, the lip connector comprising a lip sleeve configured for inserting the side lip and the extender lip, proximate to an abutment point thereof, the lip sleeve being configured for screwing to the side lip and the extender lip for coupling the side lip to the extender lip;

a side connector configured for engaging a respective side panel, proximate to the second end of the respective side panel, and for engaging an associated side extender for coupling the respective side panel to the associated side extender, the side connector comprising a side plate, the side plate having a pair of side channels extending thereinto from side edges thereof, such that one of the side channels is positioned for inserting the respective side panel and the other of the side channels is positioned for inserting the associated side extender, the side plate being configured for screwing to the respective side panel and the associated side extender for coupling the respective side panel to the associated side extending panel;

a bottom extender selectively positionable between the pair of side extenders and selectively engageable to the bottom panel for extending the covering of the bottom of the ditch;

a bottom connector configured for engaging the bottom panel and the bottom extender for coupling the bottom extender to the bottom panel, the bottom connector comprising a bottom plate, the bottom plate having a pair of bottom channels extending thereinto from side limits thereof, such that one of the bottom channels is positioned for inserting the bottom panel and the other of the bottom channels is positioned for inserting the bottom extender, the bottom plate being configured for screwing to the bottom panel and the bottom extender for coupling the bottom panel to the bottom extender;

a rod having opposing ends, each opposing end being configured for selectively coupling to a respective side extender such that the rod extends between the pair of side extenders, wherein the rod is configured for fixedly separating the side extenders; and a pair of clamps engaged singly to the opposing ends of the rod, such that the clamps are positioned for clamping to the pair of side extenders for fixedly positioning the rod between the side extenders.

* * * * *